US011088501B2

(12) United States Patent
Montminy

(10) Patent No.: US 11,088,501 B2
(45) Date of Patent: Aug. 10, 2021

(54) ELECTRICAL CONNECTOR AND DIE SET WITH A CONNECTOR GUIDE

(71) Applicant: Hubbell Incorporated, Shelton, CT (US)

(72) Inventor: Armand Thomas Montminy, Hooksett, NH (US)

(73) Assignee: HUBBELL INCORPORATED, Shelton, CT (US)

( * ) Notice: Subject to any disclaimer, the term of this patent is extended or adjusted under 35 U.S.C. 154(b) by 503 days.

(21) Appl. No.: 15/647,715

(22) Filed: Jul. 12, 2017

(65) Prior Publication Data

US 2018/0019561 A1 Jan. 18, 2018

Related U.S. Application Data

(60) Provisional application No. 62/361,278, filed on Jul. 12, 2016.

(51) Int. Cl.

| | |
|---|---|
| ***H01R 43/042*** | (2006.01) |
| ***B21D 37/12*** | (2006.01) |
| ***B21D 37/14*** | (2006.01) |
| ***H01R 43/045*** | (2006.01) |
| ***H01R 43/052*** | (2006.01) |

(52) U.S. Cl.

CPC ..... *H01R 43/0428* (2013.01); *B21D 37/12* (2013.01); *B21D 37/14* (2013.01); *H01R 43/045* (2013.01); *H01R 43/0427* (2013.01); *H01R 43/052* (2013.01)

(58) Field of Classification Search

CPC .. H01R 4/182; H01R 43/048; H01R 43/0428; H01R 43/0427; H01R 12/69; H01R 12/68; H01R 13/02; H01R 13/648; H01R 31/06; H05K 3/326; H01B 7/02; H01B 7/04; H01B 7/17

USPC ..... 439/423, 424, 430, 442

See application file for complete search history.

(56) References Cited

U.S. PATENT DOCUMENTS

| | | | | | |
|---|---|---|---|---|---|
| 2,229,758 | A | * | 1/1941 | Metcalf | H01R 43/058 403/391 |
| 2,765,019 | A | * | 10/1956 | Evans | H01R 43/058 72/455 |
| 2,983,898 | A | * | 5/1961 | Kalmar | H01R 43/058 439/868 |
| 3,825,881 | A | * | 7/1974 | Wigby | H01R 12/67 439/422 |
| 3,905,220 | A | * | 9/1975 | Sosinski | B21D 37/10 72/475 |
| 3,932,018 | A | * | 1/1976 | Parsons | H01R 12/67 439/422 |
| 3,940,838 | A | * | 3/1976 | Gryctko | H01R 43/042 29/751 |

(Continued)

OTHER PUBLICATIONS

International Search Report and Written Opinion mailed in corresponding PCT Application PCT/US2017/041676 dated Jan. 2, 2018.

*Primary Examiner* — Gregory D Swiatocha
(74) *Attorney, Agent, or Firm* — Wissing Miller LLP

(57) ABSTRACT

Die sets for crimping busses to electrical connectors are provided. The die set includes a pair of dies where one die has a guide member for aligning the dies with the electrical connector, and the other die has a one or more indentors for impacting the electrical connector. The electrical connectors include a guide hole that receives the guide member.

22 Claims, 7 Drawing Sheets

(56) References Cited

U.S. PATENT DOCUMENTS

| | | | | |
|---|---|---|---|---|
| 4,982,594 | A * | 1/1991 | Wiebe | H01R 43/04 72/409.14 |
| 6,232,555 | B1 * | 5/2001 | Besler | H01R 4/182 174/84 C |
| 6,769,173 | B2 * | 8/2004 | Chadbourne | H01R 43/0428 29/283.5 |
| 7,165,439 | B2 | 1/2007 | Lefavour et al. | |
| 7,591,666 | B2 * | 9/2009 | Legrady | H01R 4/2404 439/424 |
| 8,997,543 | B2 * | 4/2015 | Therrien | B21D 37/10 72/414 |
| 9,166,353 | B1 * | 10/2015 | Doornbos | H01R 43/048 |
| 9,397,410 | B2 * | 7/2016 | Corman | H01R 4/185 |
| 10,312,653 | B2 * | 6/2019 | Ballard | H01R 43/0427 |
| 2002/0064978 | A1 * | 5/2002 | De France | H01R 4/38 439/100 |
| 2003/0015023 | A1 | 1/2003 | Connor et al. | |
| 2010/0236315 | A1 * | 9/2010 | Robinson | B23D 29/00 72/325 |
| 2011/0136397 | A1 * | 6/2011 | Koga | H01R 4/185 439/877 |
| 2011/0223799 | A1 * | 9/2011 | Hasebe | H01R 4/184 439/488 |
| 2012/0028494 | A1 * | 2/2012 | Ono | H01R 4/185 439/442 |
| 2013/0035007 | A1 | 2/2013 | Onuma | |
| 2016/0285176 | A1 * | 9/2016 | Castonguay | H01R 4/182 |
| 2017/0256901 | A1 * | 9/2017 | Boutin | H01R 43/0427 |

* cited by examiner 100
80
84
88
90
92
90
86
92
82
96
96
98
98
32
74
76
76
62
60
31
66
64
33
30
72
70
14

ELECTRICAL CONNECTOR AND DIE SET WITH A CONNECTOR GUIDE

CROSS REFERENCE TO RELATED APPLICATIONS

The present application is based on and claims benefit from U.S. Provisional Application Ser. No. 62/361,278 filed Jul. 12, 2016 entitled "Electrical Connector and Die Set with a Connector Guide" the entire contents of which are incorporated herein by reference.

BACKGROUND

Field

The present disclosure relates generally to die sets for power tools and electrical connectors, and more particularly to die sets that have a guide to align with the connectors when crimping.

Description of the Related Art

Many portable power tools are hand held tools that have electric motors to drive a working head used to perform various tasks, such as crimping, drilling, shaping, fastening, grinding, polishing, heating, etc. There is a segment of the portable tool market that incorporate a hydraulic pump to enable the working head to apply a relatively large amount of force or pressure for a particular task. Such tools may operate with a hydraulic pump actuated by a battery powered electric motor. Battery powered hydraulic power tools are employed in numerous applications to provide an operator with a desired flexibility and mechanical advantage. For example, operators of crimping tools used for making crimping connections, such as crimping large power connectors onto large conductors or busses, may need added force to crimp such large conductors or busses to suitable connectors. Such battery powered hydraulic power tools can come with dies to perform the crimping operation.

A buss may include one or more electrical conductors that serve as a common connection between load circuits and a source of electrical power. Busses are produced in a variety of sizes and shapes, such as flat strips, solid bars, solid rods, solid tubes, hollow tubes, and braided wire. Busses that incorporate multiple flat strips of electrical conductors are included as flexible busses. Flexible busses are more pliable than rigid, solid bars, rods, tubes, or hollow tubes so that the buss may be more easily manipulated and connected to an end point such as a connector or lug. The aforementioned power tools can have dies used to make mechanical and electrical connections between flexible busses and endpoints, such as connectors, by crimping the endpoint.

SUMMARY

The present disclosure provides descriptions of embodiments of die sets for crimping busses to electrical connectors. In an exemplary embodiment, the die set includes a first die and a second die. The first die has a body, a face plate associated with the body and at least one guide member extending from the first die face plate. The first die body is shaped to fit within a nest on a working head of a power tool. As a non-limiting example, the body may be substantially U-shaped to fit within a U-shaped nest. Each guide member has a proximal end attached to or integrally formed into the face plate of the first die, and a free distal end. Preferably, each guide member is substantially perpendicular to the first die face plate. The second die has a body, a face plate associated with the body and at least one indentor extending from the face plate and having a free distal end. The second die body is shaped to fit within a nest on a working head of a power tool. As a non-limiting example, the body may be substantially U-shaped to fit within a U-shaped nest. Each indentor has a proximal end attached to or integrally formed into the face plate of the second die, and a free distal end. Preferably, each indentor is substantially perpendicular to the second die face plate.

The present disclosure also provides descriptions of embodiments for electrical connectors. In an exemplary embodiment, the electrical connector includes a body, a first arm extending from the body, a second arm extending from the body, and a crimping channel between the first and second arms. The first arm has an inner surface associated with the crimping channel with one or more grooves and a guide hole accessible from an outer surface of the first arm. The second arm has an inner surface with one or more detents extending into the crimping channel and one or more grooves on an outer surface of the second arm. The body, first arm and second arm are made from an electrically conductive material, such for example as copper or aluminum.

The present disclosure also provides descriptions of embodiments for connector and die set kits. In an exemplary embodiment, a connector and die set kit includes an electrical connector and a die set for power tools used to crimp the electrical connector. The electrical connector includes a body, a first arm extending from the body, a second arm extending from the body, and a crimping channel between the first and second arms. The first arm has an inner surface associated with the crimping channel with one or more grooves and a guide hole accessible from an outer surface of the first arm. The second arm has an inner surface with one or more detents extending into the crimping channel and one or more grooves on an outer surface of the second arm. The body, first arm and second arm of the connector are made from an electrically conductive material, such for example as copper or aluminum. The die set includes a first die and a second die. The first die has a body, a face plate associated with the body and at least one guide member extending from the first die face plate. The first die body is shaped to fit within a nest on a working head of a power tool. As a non-limiting example, the body may be substantially U-shaped to fit within a U-shaped nest. Each guide member has a proximal end attached to or integrally formed into the first die face plate, and a free distal end. Preferably, each guide member is substantially perpendicular to the first die face plate. The guide member is configured to engage the connector guide hole to align the electrical connector with the die set when crimping. The second die has a body, a face plate associated with the body and at least one indentor extending from the face plate of the second die. The second die body is shaped to fit within a nest on a working head of a power tool. As a non-limiting example, the body may be substantially U-shaped to fit within a U-shaped nest. Each indentor has a proximal end attached to or integrally formed into the second die face plate, and a free distal end. Preferably, each indentor is substantially perpendicular to the second die face plate, and is aligned to engage the one or more grooves on the outer surface of the second arm of the connector when crimping.

The present disclosure also provides descriptions of embodiments for connector, die set and power tool kits. In an exemplary embodiment a connector, die set and power tool kit includes an electrical connector, a die set for power tools, and a power tool used to crimp the electrical connector using the die set. The electrical connector includes a body, a first arm extending from the body, a second arm extending from the body, and a crimping channel between the first and second arms. The first arm has an inner surface associated with the crimping channel with one or more grooves and a guide hole accessible from an outer surface of the first arm. The second arm has an inner surface with one or more detents extending into the crimping channel and one or more grooves on an outer surface of the second arm. The body, first arm and second arm are made from an electrically conductive material, such for example as copper or aluminum.

The die set includes a first die and a second die. The first die has a body, a face plate associated with the body and at least one guide member extending from the face plate. The first die body is shaped to fit within a nest on a working head of a power tool. As a non-limiting example, the body may be substantially U-shaped to fit within a U-shaped nest. Each guide member has a proximal end attached to or integrally formed into the face plate of the first die, and a free distal end. Preferably, each guide member is substantially perpendicular to the face plate. Each guide member is configured to engage the connector guide hole to align the electrical connector with the die set when crimping. The second die has a body, a face plate associated with the body and at least one indentor extending from the face plate of the second die. The second die body is shaped to fit within a nest on a working head of a power tool. As a non-limiting example, the body may be substantially U-shaped to fit within a U-shaped nest. Each indentor has a proximal end attached to or integrally formed into the second die face plate, and a free distal end. Preferably, each indentor is substantially perpendicular to the second die face plate, and is aligned to engage the one or more grooves on the outer surface of the second arm of the connector when crimping.

The hand-held power tool includes a movable ram nest configured to receive the first die or the second die and a fixed frame nest to configured receive the first die or the second die so that when the power tool is activated the power tool causes the movable ram nest to move towards the frame nest so that the electrical connector positioned between the first and second dies is crimped.

BRIEF DESCRIPTION OF THE DRAWINGS

The figures depict embodiments for purposes of illustration only. One skilled in the art will readily recognize from the following description that alternative embodiments of the structures illustrated herein may be employed without departing from the principles described herein, wherein.

DETAILED DESCRIPTION

Figure 1:
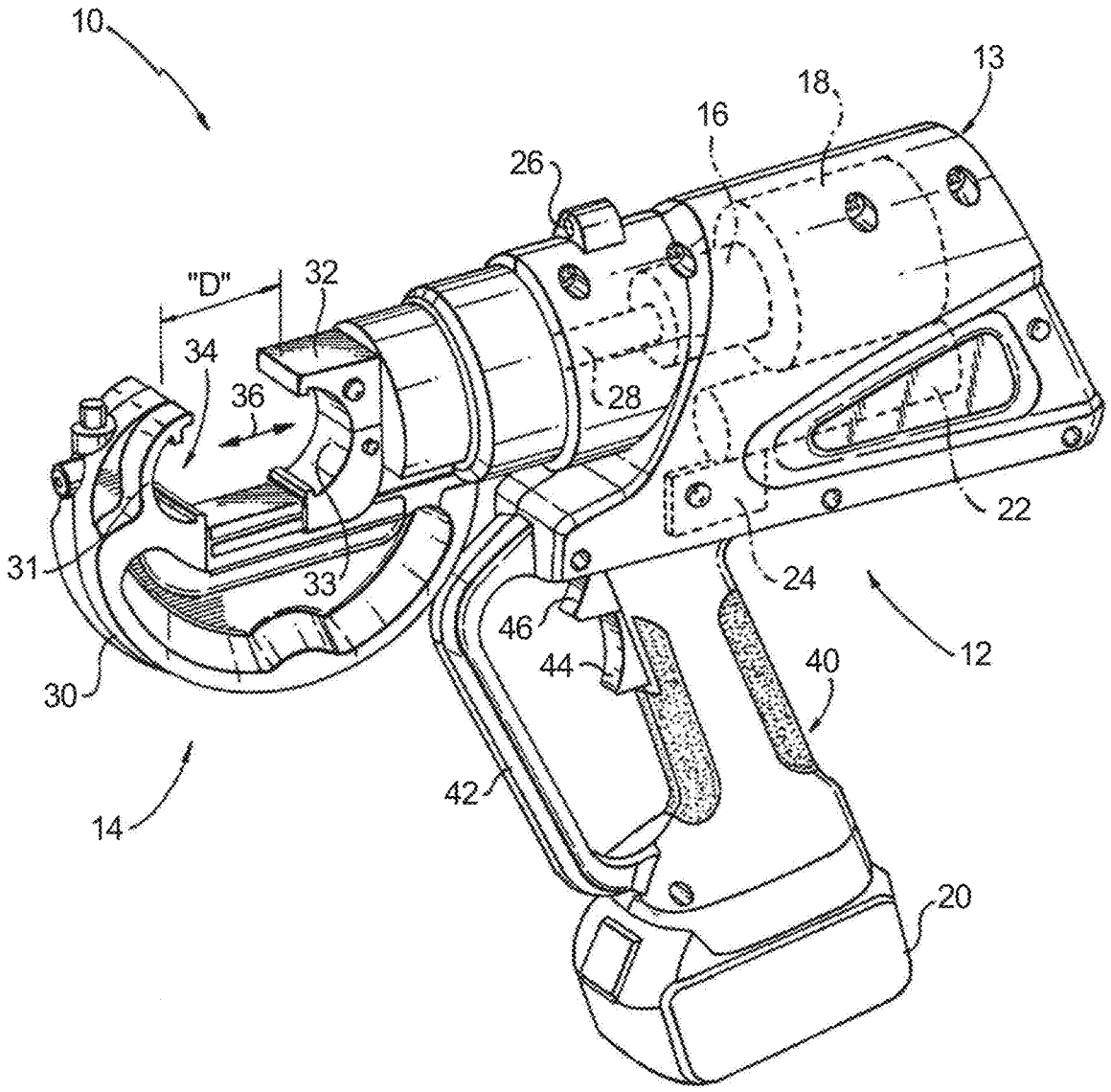
FIG. 1 is a perspective view of a battery operated hydraulic crimping tool according to the present disclosure.

Referring to FIG. 1, an exemplary embodiment of a portable hand tool 10 according to the present disclosure is shown. Although the present disclosure describes the hand tool as a portable, hand held, battery operated, hydraulic crimping tool, it should be understood that the tool of the present disclosure can be any tool capable of receiving the dies disclosed herein and crimping the connectors disclosed herein. In addition, any suitable size, shape or type of elements or materials can be used to form the shape of the tool frame. For ease of description, the portable, hand held, battery operated, hydraulic crimping tool shown and described herein will be referred to as the "tool."

Figure 2:
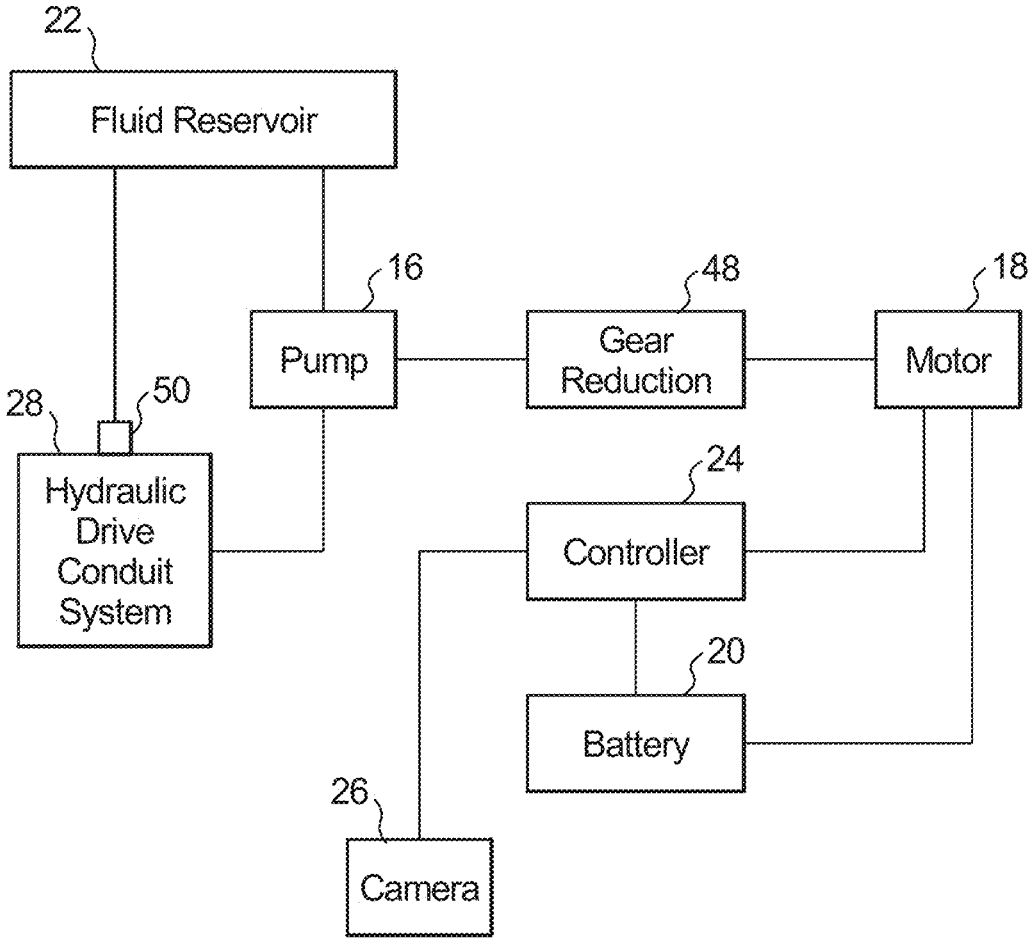
FIG. 2 is a block diagram of components of the tool shown in FIG. 1.

Referring to FIGS. 1 and 2, the tool 10 according to an exemplary embodiment of the present disclosure generally includes a frame 12 and a working head 14. The frame 12 includes a pump 16, a motor 18, a battery 20, a fluid reservoir 22, a controller 24 and a hydraulic drive conduit system 28. The frame 12 includes a main body 13 and a handle 40 that form a pistol-like shape. However, the frame 12 could be in any suitable shape, such as an in-line shape. The pump 16, motor 18, fluid reservoir 22, controller 24, and hydraulic drive conduit system 28 are located within the main body 13 of the frame 12. The tool 10 may also include a camera 26 mounted to the frame 12 and oriented to provide a video of a working area of the working head 14, as will be described in more detail below.

The working head 14 includes a frame section 30 and a ram 32. The frame section 30 may be connected to the front end of the frame 12 and fixed or locked in position, or the frame section 30 may be rotatably connected to the frame 12. The frame section 30 includes a nest 31 adapted to removably receive a crimping die of a die set, seen in FIGS. 3 and 4, in a working area 34 of the working head 14.

The ram 32 includes a nest 33 adapted to removably receive a crimping die of the die set in the working area 34 of the working head 14. The ram 32 is movably connected to the frame section 30 of the working head 14. The ram 32 is adapted to move forward and backward as indicated by arrow 36. The hydraulic drive conduit system 28 is connected between the pump 16 and the rear end of the ram 32. Hydraulic fluid pumped by the pump 16 through the hydraulic drive conduit system 28 and against the rear end of the ram 32 causes the ram 32 to move forward toward a distal end of the working head 14. The tool 10 preferably includes a spring (not shown) which is adapted, as is known in the art, to return the ram 32 to its rearward (or home) position when hydraulic fluid pressure is removed from the rear end of the ram 32. In the exemplary embodiment shown, the ram 32 has a rear end diameter of about 2 inches. However, the diameter of the rear end of the ram could have any suitable size or shape for functioning as a hydraulic fluid contact surface. In the exemplary embodiment shown, the ram 32 is adapted to move a distance "D" between its home position and its forward position which is towards the distal end of the working head 14. The distance "D" can be any distance suitable to perform the desired action of the working head 14, here the desired crimping action. For example, the distance "D" could be between about 1 inch and about 2 inches, such as about 1.7 inches.

The handle 40 of the frame 12 may include a hand guard 42 to protect an operators hand while operating the tool 10. The handle 40 includes one or more operator controls, such as trigger switches 44 and 46, that can be activated by an operator by, for example, pressing the trigger switches. The operator controls, e.g., trigger switches 44 and 46, are operably coupled to the controller 24, as will be described below. As shown in FIG. 1, the battery 20 is removably connected to the bottom of the handle 40. In another embodiment, the battery 20 could be removably mounted or connected to any suitable position on the frame 12. In another embodiment, the battery 20 may be affixed to the tool 10 so that it is not removable. The battery 20 is preferably a rechargeable battery, such as a lithium ion battery, that can output a voltage of at least 16 volts, and preferably in the range of between about 16 VDC and about 24 VDC. In the exemplary embodiment shown in FIG. 1, the battery 20 can output a voltage of about 18 VDC.

The motor 18 is coupled to the battery 20 and the controller 24, and its operation is controlled by the controller 24, which will be described in more detail below. Generally, the motor 18 is adapted to operate at a nominal voltage corresponding to the voltage of the battery 20, i.e., between about 16 volts and about 24 volts. For example, if the battery 20 is adapted to output a voltage of about 18 volts, then the motor 18 would be adapted to operate at a voltage of about 18 volts. Under a no-load condition, such a motor 18 can operate at about 19,500 rpm with a current of about 2.7 amps. At maximum efficiency, the motor 18 can operate at about 17,040 rpm with a current of about 18.7 amps, a torque of about 153 mN-m (1560 g-cm), and an output of about 273 W. An example of such an 18-volt motor 18 may be a RS-775WC-8514 motor, manufactured by Mabuchi Motor Co., Ltd. of Chiba-ken, Japan. However, as noted above, any suitable type of motor adapted to operate above a 16 V nominal voltage could be used. For example, the motor may be a RS-775VC-8015 motor, also manufactured by Mabuchi Motor Co., Ltd., which has a nominal operating voltage of about 16.8 volts. As another example, the motor may be a motor adapted to operate at a 24 V nominal voltage. The output shaft of the motor 18 is connected to the pump 16 by a gear reduction or gearbox 48. Any suitable type of gear reduction assembly could be provided.

Referring again to FIG. 2, the tool 10 may include a poppet valve 50 connected to the hydraulic drive conduit system 28. The poppet valve 50 is adapted to open when the conduit system 28 reaches a predetermined pressure, such as between about 8000 psi and about 11,000 psi. When the poppet valve opens, hydraulic fluid being pumped by the pump 16 can exit the conduit system 28 and return to the fluid reservoir 22. The poppet valve 50 can be adapted to generate an audible sound when it opens. This audible sound can signal to the operator that the tool 10 has reached its maximum predetermined hydraulic pressure and, thus, the action of the working head 14, e.g., crimping action, is ready to be triggered.

In the exemplary embodiment shown in FIG. 2, the controller 24 is adapted to sense a current drop of electricity to the motor 18. When the poppet valve 50 opens, resistance to rotation of the motor 18 is reduced such that the motor draws less current. The controller 24 senses this current drop via a current sensor (not shown), and automatically deactivates the motor 18 for a predetermined period of time. In a preferred embodiment, the predetermined period of time can be between about 2 seconds and about 3 seconds. However, any suitable predetermined period of time could be set. In an alternate embodiment, the controller 24 could be adapted to deactivate the motor 18 until a reset button or reset-like procedure is performed by the operator. With this type of system, an operator can sense via a tactile sense, that the motor 18 and pump 16 have stopped and would not need to rely on an audible signal being heard or a visual signal from an LED indicator light positioned on the tool 10. More detailed information of this exemplary embodiment of the tool 10 and its operation can be found in U.S. Pat. No. 7,165,439 entitled "Battery Powered Hydraulic Tool" which is incorporated herein by reference.

Figure 3:
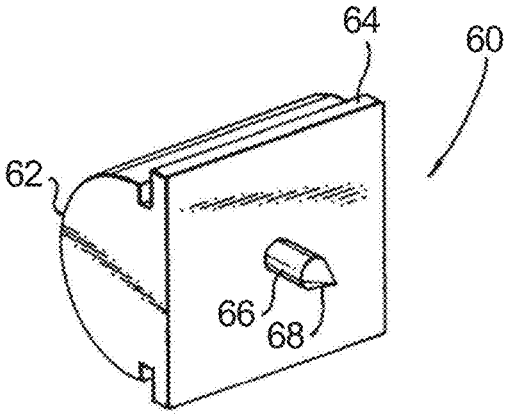
FIG. 3 is a perspective view of an exemplary embodiment of a die of a die set according to the present disclosure for use in the tool of FIG. 1.

Referring to FIG. 3, an exemplary embodiment of a crimping die 60 of the die set according to the present disclosure is shown. As noted above, the ram 32 is adapted to removably receive the crimping die 60 in the ram nest 33 of the ram 32 seen in FIG. 1. In this exemplary embodiment, the die 60 is a U type die having a U-shaped body 62, a substantially flat face plate 64 and a guide member 66. The U-shaped body 62 is configured to fit within the ram nest 33 and to be releasably secured to the ram 32. The face plate 64 may be integrally formed into or secured to the body 62 and provides a substantially flat surface for engaging a connector being crimped. The guide member 66 may be integrally formed into or attached to face plate 64 such that a distal end of the guide member is substantially perpendicular to the face plate 64. The guide member 66 is used to guide the die 60 into engagement with a connector positioned between the dies. The distal end of the guide member 66 may be a tapered or rounded end 68 that permits the guide member 66 to more easily engage an opening in the connectors, as described below with reference to FIGS. 8 and 9.

Figure 4:
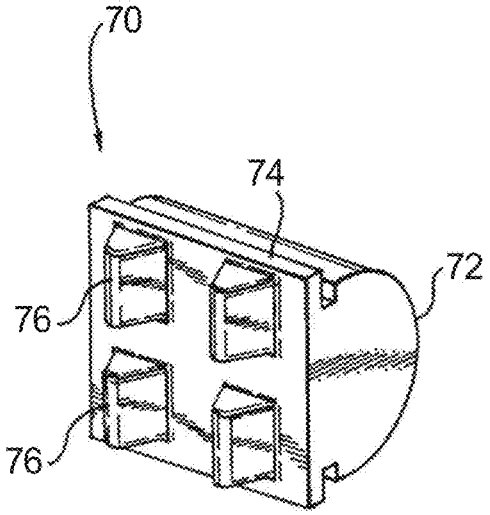
FIG. 4 is a perspective view of an exemplary embodiment of another die of the die set according to the present disclosure for use in the tool of FIG. 1.

Referring to FIG. 4, an exemplary embodiment of a crimping die 70 of the die set according to the present disclosure is shown. As noted above, the frame section 30 of the working head 14 is adapted to removably receive the crimping die 70 in the frame nest 31 of the ram 32 seen in FIG. 1. In this exemplary embodiment, the die 70 is a U type die having a U-shaped body 72, a substantially flat face plate 74 and one or more indentors 76. The U-shaped body 72 is configured to fit within the frame nest 31 and to be releasably secured to the frame 30. The face plate 74 may be integrally formed into or secured to the body 72 and provides a substantially flat surface for engaging a connector being crimped. The one or more indentors 76 may be integrally formed into or attached to face plate 74 such that a distal end of each indentor is substantially perpendicular to the face plate 74. The distal end of each indentor 76 is shaped to fit within slots in a connector as described below. The indentors are made of a hardened material, such as hardened steel, so that the indentors can withstand multiple impacts against connectors being crimped.

While the embodiment described herein has the die 60 attached to the ram 32 and the die 70 attached to the frame portion 30, the die 60 can be attached to the frame portion 30 and the die 70 can be attached to the ram.

Figure 5:
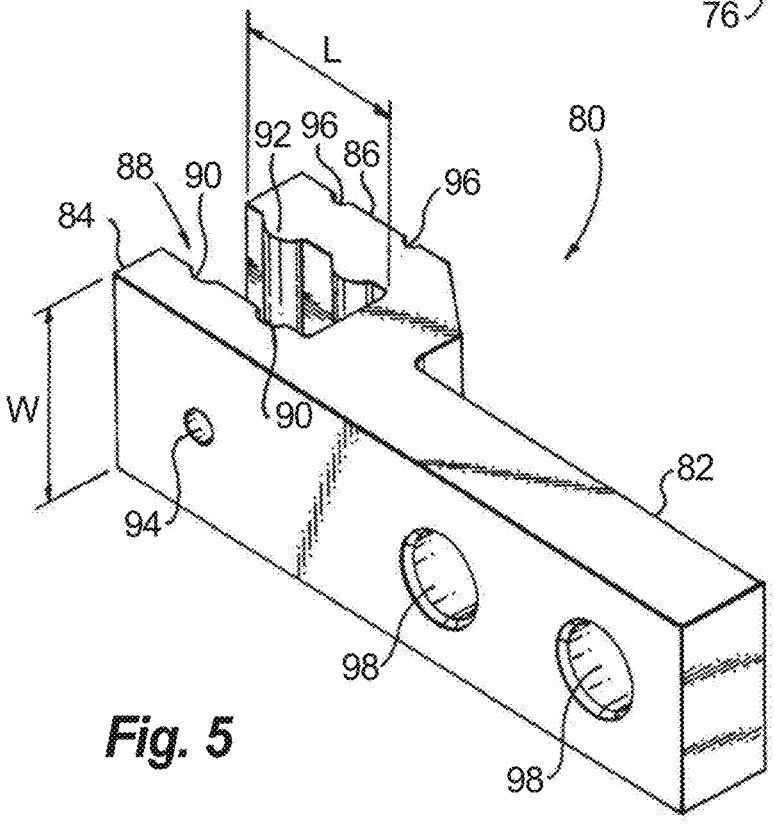
FIG. 5 is a perspective view of connector that can be crimped by the tool of FIG. 1 using the dies of FIGS. 3 and 4.
Figure 6:
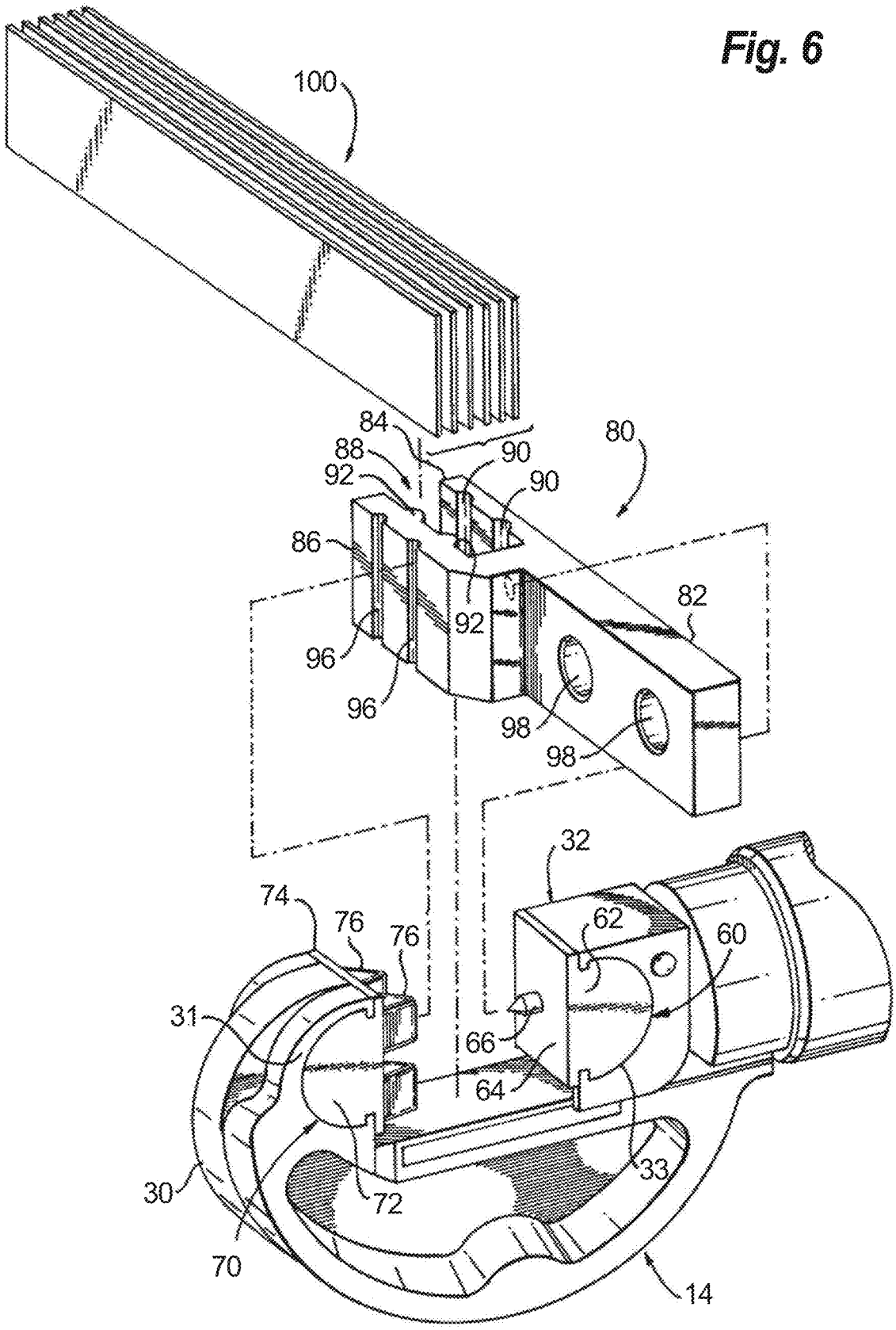
FIG. 6 is an expanded perspective view of a working head of the tool of FIG. 1, illustrating a flexible buss and an endpoint for positioning between dies positioned in the working head.

Referring now to FIG. 5, an exemplary embodiment of an endpoint 80, e.g., a connector, according to the present disclosure that may be crimped by the tool 10 is shown. The connector 80 in this exemplary embodiment is a buss connector configured to be secured to a plurality of flexible flat strip conductors forming a buss 100, seen in FIG. 6. The connector 80 has a body 82 and a pair of arms 84 and 86 extending from the body 82. The connector 80 is preferably made of an electrically conductive material, such as copper, aluminum, stainless steel or brass. The arms 84 and 86 are spaced apart to form a crimping channel 88 between the arms. The crimping channel 88 has a length L and a width W which are dependent at least in part upon the size of the connector and the size of the buss to be crimped to the connector 80. In the exemplary embodiment shown, the arms 84 and 86 extended from the body 82 such that they are in-line with the body. In another embodiment, the arms 84 and 86 may be at an angle relative to the body 82, such as at a right angle relative to the body 82.

Figure 9:
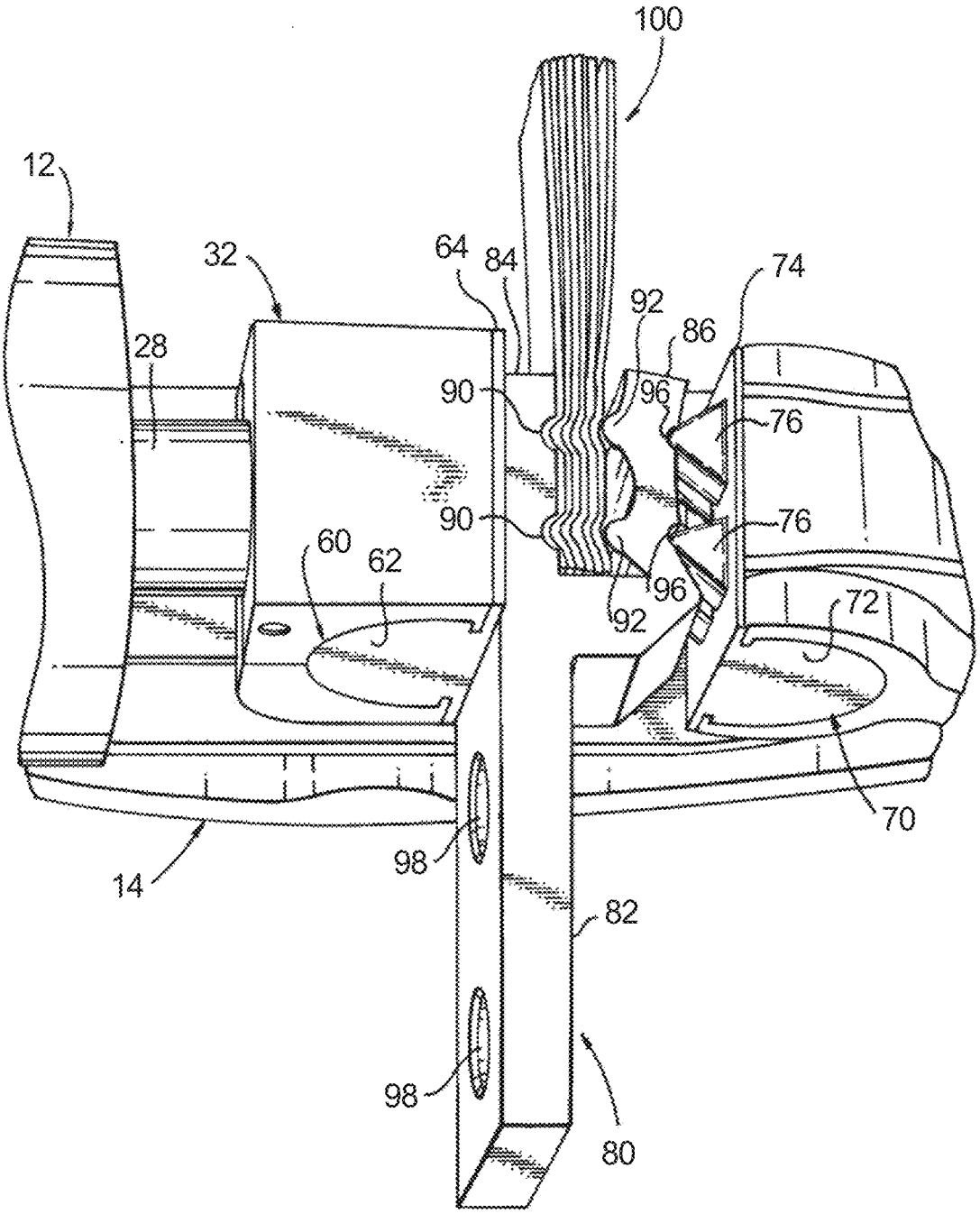
FIG. 9 is a top perspective view similar to FIG. 8, illustrating the dies, connector and buss at the end of the crimp cycle.

An inner surface of the arm 84 has one or more grooves 90 that are aligned with one or more detents 92 on an inner surface of the arm 86. The grooves 90 and detents 92 extend along the width W of the respective arm 84 or 86 as shown. When the connector 80 is crimped, the grooves 90 and detents 92 provide additional gripping force to maintain the one or more flexible strip conductors forming the buss 100 between the arms 84 and 86. The arm 84 also includes a guide hole 94 that is aligned with the center of the crimping channel 88, as shown in FIG. 5. The arm 86 includes grooves or slots 96 that are positioned on an outer surface of the arm 86 to align the indentors 76 on die 70 with the detents 92 so that when crimping the indentors 76 cause the detents to impose a corresponding detent in the buss, as seen in FIG. 9. The connector 80 may also include one or more mounting apertures 98 that may be used to secure the connector to a support structure, such as a circuit breaker application or a bus bar.

Figure 7:
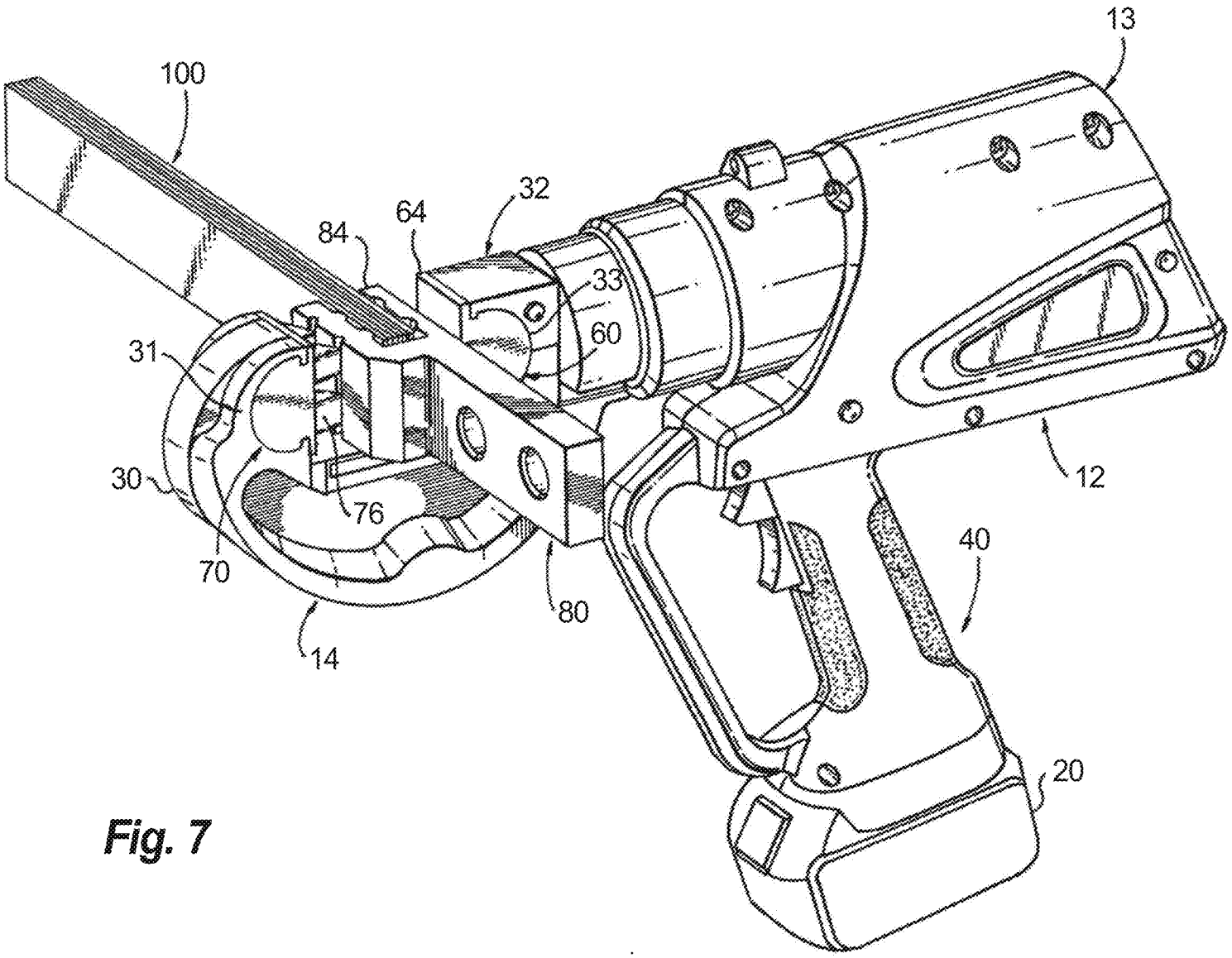
FIG. 7 is a perspective view of the tool of FIG. 1, illustrating the connector positioned between dies of the working head of FIG. 6 and a buss within the connector.
Figure 8:
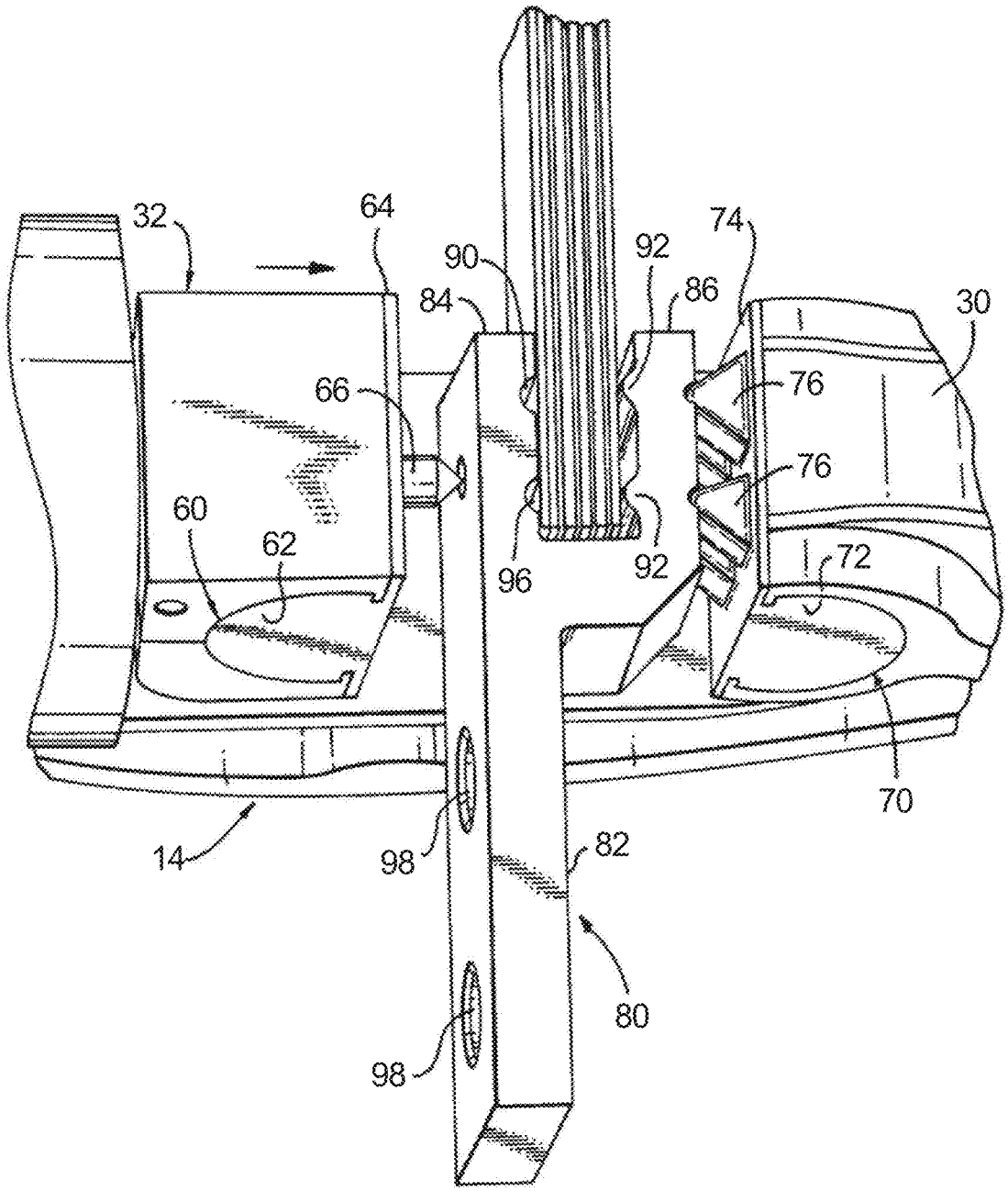
FIG. 8 is a top perspective view of a buss positioned in a connector with the connector located between dies in the working head of the tool of FIG. 7 before crimping.

Referring now to FIGS. 6-9, to crimp a buss 100 to a connector 80, the connector is positioned between the dies 60 and 70 in the working head 14 of the tool 10 so that arm 84 is adjacent die 60 and arm 86 is adjacent die 70. A buss 100 is then positioned in the crimping channel 88. The trigger 44 of the tool 10, seen in FIG. 1, is activated to cause the ram 32, and thus die 60, to move towards die 70. As the die 60 is moving into engagement with the arm 84 of the connector 80, the guide hole 94 is aligned with the guide member 66 on the die 60 so that the guide member enters the guide hole. By entering the guide hole 94 the guide member 66 is ensuring that the connector 80 is centered relative to the indentors 76 on die 70. The indentors 76 are then aligned with the grooves 96 in the arm 86 of the connector 80, as seen in FIGS. 7 and 8 to ensure a maximum crimping operation. Once the connector 80 is aligned with the dies 60 and 70 the trigger 44 is further pressed so that the ram 32 moves to the forward or impacting position where the indentors 76 impact the grooves 96 in the outer surface of arm 86 of connector 80 and crimp the buss 100 to the connector 80, as seen in FIG. 9.

The above specification describes a new and improved device for aligning a connector between dies to make a good electrical and mechanically connection between a bus and connector. It is realized that the above description may indicate to those skilled in the art additional ways in which the principles of this invention may be used without departing from its spirit. It is, therefore, intended that this invention be limited only by the scope of the appended claims.

What is claimed is:

1. A die set for power crimping tools used to impact objects comprising:

a first die including a first body having a first face plate and a guide member extending from the first face plate, the guide member having a free distal end and is configured to engage a guide hole in an object to align the object with the die set when crimping; and a second die including a second body having a second face plate and at least one indentor extending from the second face plate, the at least one indentor being made of a hardened material that can withstand multiple impacts against objects being impacted, and having a free distal end, wherein the at least one indentor is aligned on the second face plate to engage one or more grooves on the object when crimping.

2. The die set according to claim 1, wherein the guide member has a proximal end attached to the first face plate.

3. The die set according to claim 1, wherein the guide member has a proximal end integrally formed into the first face plate.

4. The die set according to claim 1, wherein the guide member is substantially perpendicular to the first face plate.

5. The die set according to claim 1, wherein the first face plate and the second face plate are substantially flat.

6. The die set according to claim 1, wherein the first body and the second body are substantially U-shaped.

7. The die set according to claim 1, wherein the at least one indentor has a proximal end attached to the second face plate.

8. The die set according to claim 1, wherein the at least one indentor has a proximal end integrally formed into the second face plate.

9. The die set according to claim 1, wherein the at least one indentor is substantially perpendicular to the second face plate.

10. A connector and die set kit comprising:

an electrical connector comprising:

a body;

a first arm extending from the body;

a second arm extending from the body; and a crimping channel between the first and second arms, wherein the first arm has an inner surface with one or more grooves and a guide hole formed in an outer surface of the first arm; and wherein the second arm has an inner surface with one or more detents extending into the crimping channel and one or more grooves on an outer surface of the second arm; and a die set for power tools used to crimp the electrical connector, the die set comprising:

a first die including a first body having a first face plate and a guide member extending from the first face plate, the guide member having a free distal end, wherein the guide member is configured to engage the guide hole to align the electrical connector with the die set when crimping; and a second die including a body having a second face plate and a plurality of indentors extending from the second face plate, each of the plurality of indentors having a free distal end, wherein the plurality of indentors are aligned to engage the one or more grooves on the outer surface of the second arm when crimping.

11. The connector and die set kit according to claim 10, wherein the body, first arm and second arm of the electrical connector are made from an electrically conductive material.

12. The connector and die set kit according to claim 11, wherein the electrically conductive material is copper.

13. The connector and die set kit according to claim 11, wherein the electrically conductive material is aluminum.

14. The connector and die set kit according to claim 10, wherein the guide member has a proximal end attached to the first face plate.

15. The connector and die set kit according to claim 10, wherein the guide member has a proximal end integrally formed into the first face plate.

16. The connector and die set kit according to claim 10, wherein the guide member is substantially perpendicular to the first face plate.

17. The connector and die set kit according to claim 10, wherein the first face plate and the second face plate are substantially flat.

18. The connector and die set kit according to claim 10, wherein the first body and the second body are substantially U-shaped.

19. The connector and die set kit according to claim 10, wherein each of the plurality of indentors has a proximal end attached to the second face plate.

20. The connector and die set kit according to claim 10, wherein each of the plurality of indentors has a proximal end integrally formed into the second face plate.

21. The connector and die set kit according to claim 10, wherein each of the plurality of indentors is substantially perpendicular to the second face plate.

22. An electrical connector, die set and power tool kit comprising:

an electrical connector comprising:

a body;

a first arm extending from the body;

a second arm extending from the body; and a crimping channel between the first and second arms, wherein the first arm has an inner surface with one or more grooves and a guide hole formed in an outer surface of the first arm; and wherein the second arm has an inner surface with one or more detents extending into the crimping channel and one or more grooves on an outer surface of the second arm; and a die set for power tools used to crimp the electrical connector, the die set comprising:

a first die including a first body having a first face plate associated with the body and a guide member extending from the first face plate, the guide member having a free distal end, wherein the guide member is configured to engage the guide hole to align the electrical connector with the die set when crimping; and a second die including a second body having a second face plate associated with the body and a plurality of indentors extending from the second face plate, each of the plurality of indentors having a free distal end, wherein the plurality of indentors are aligned to engage the one or more grooves on the outer surface of the second arm when crimping; and a hand-held power tool having a movable ram nest to receive one of the first die or the second die and a fixed frame nest to receive one of the first die or the second die, such that when activated the power tool causes the movable ram nest to move towards the frame nest so that the electrical connector positioned between the first and second dies is crimped.

* * * * *